US005816541A

United States Patent [19]

Joyce, Jr. et al.

[11] Patent Number: 5,816,541

[45] Date of Patent: Oct. 6, 1998

[54] ELECTRONIC BLUE FLAG SAFETY EQUIPMENT

[75] Inventors: Michael J. Joyce, Jr., Jefferson Borough; Frank Huchrowski, East McKeesport; Gregory S. Balukin, Pittsburgh, all of Pa.

[73] Assignee: Westinghouse Air Brake Company, Wilmerding, Pa.

[21] Appl. No.: 831,076

[22] Filed: Apr. 1, 1997

[51] Int. Cl.[6] ..... B61L 23/00

[52] U.S. Cl. ..... 246/1 R; 235/382; 246/167 R; 307/10.5; 307/326

[58] Field of Search ..... 246/1 R, 164, 246/165, 167 R, 169 R, 182 R, 183, 184; 180/287; 235/382, 382.5; 307/9.1, 10.3, 10.5, 326, 328; 340/825.3, 825.31, 825.32, 825.34

[56] References Cited

U.S. PATENT DOCUMENTS 4,637,668 1/1987 Kleffman et al. ..... 246/1 R 5,585,614 12/1996 VonBallmoos ..... 235/382

5,629,508 5/1997 Findley et al. ..... 235/382

5,684,338 11/1997 Linton et al. ..... 307/10.5

*Primary Examiner*—Mark Tuan Le

*Attorney, Agent, or Firm*—James Ray & Associates

[57] ABSTRACT

A method of preventing movement of a locomotive while personnel are working on the locomotive. The method includes placing the brakes of the locomotive under the control of a card reading control box, and providing personnel employed to work on the locomotive with identification cards readable by the box. Each worker inserts his or her card in the box before working on the locomotive, and the control box reads the cards and in response thereto maintains the brakes of the locomotive at full service until personnel have left the locomotive and the control box is cleared by workers again inserting their cards in the box or by a master key in the position of an engineer/operator of a locomotive.

10 Claims, 1 Drawing Sheet

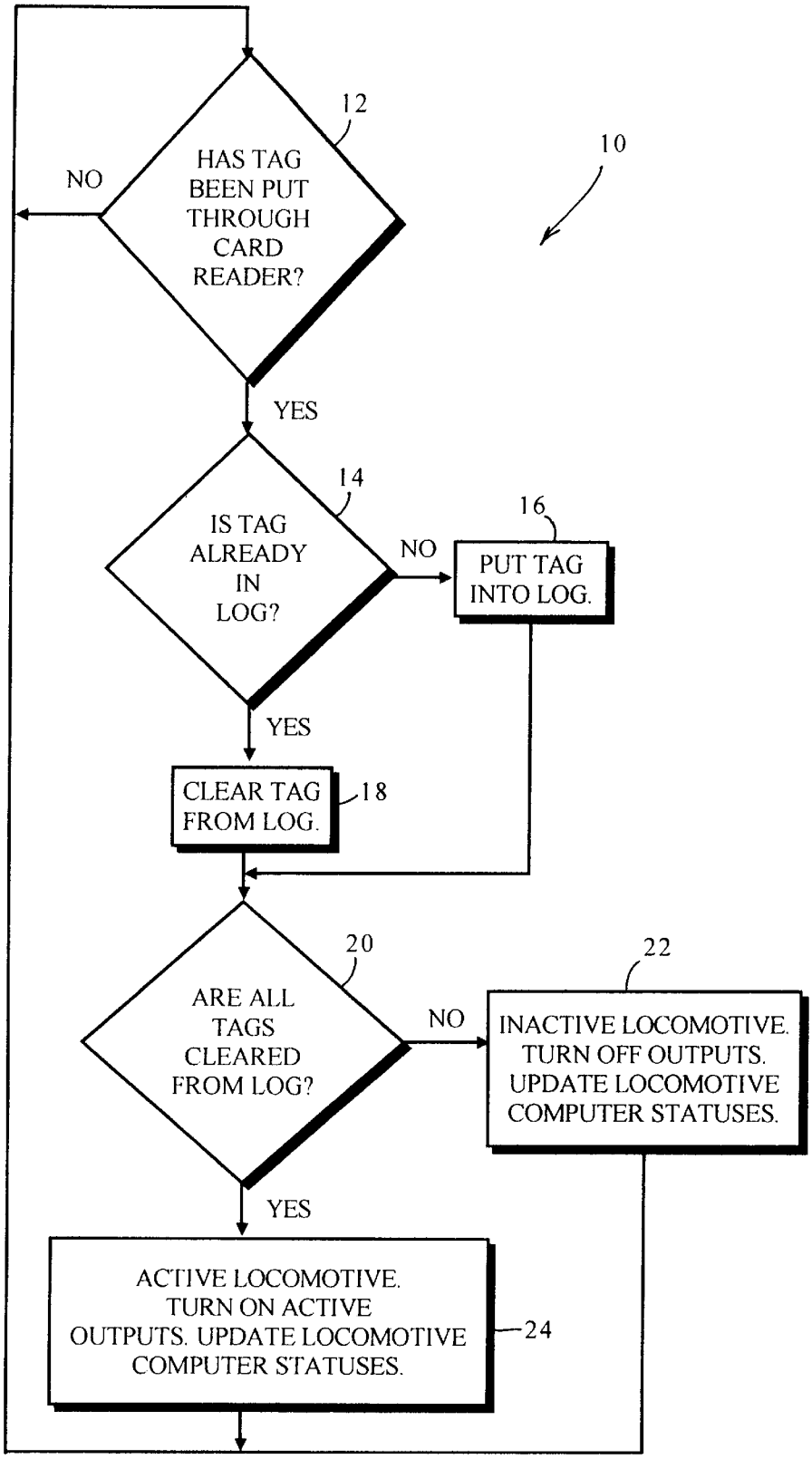
10
12
HAS TAG BEEN PUT THROUGH CARD READER?
NO
YES
14
IS TAG ALREADY IN LOG?
NO
16
PUT TAG INTO LOG.
YES
CLEAR TAG FROM LOG.
18
20
ARE ALL TAGS CLEARED FROM LOG?
NO
22
INACTIVE LOCOMOTIVE. TURN OFF OUTPUTS. UPDATE LOCOMOTIVE COMPUTER STATUSES.
YES
ACTIVE LOCOMOTIVE. TURN ON ACTIVE OUTPUTS. UPDATE LOCOMOTIVE COMPUTER STATUSES.
24

ELECTRONIC BLUE FLAG SAFETY EQUIPMENT

BACKGROUND OF THE INVENTION

The present invention relates, generally, to a safety method and means for preventing operation of a railway locomotive while it is being repaired and, more particularly, to a card reading procedure that prevents the locomotive from being moved while workers are working on the locomotive.

A safety concern on railroads is injury caused by an engineer moving a locomotive without knowing there are others inspecting or repairing the unit. Railroad companies have implemented a Blue Flag safety procedure to prevent such occurrence. Presently, all personnel working on a locomotive are required to place a blue flag with their names on the flag in the locomotive's cab. No one is permitted to move any locomotive tagged in this manner. Unfortunately, this does not always protect against poorly trained or careless operators, or just plain human error.

BRIEF SUMMARY OF THE INVENTION

The present invention is directed to the use of a card reading control box electrically connected to at least the brakes and preferably also the throttle of a locomotive. Identification cards are issued to respective workers who work on, repair and/or inspect locomotives. The control box has the capability of reading the cards and ordering the application of the brakes and restraint of the throttle, as well as the release of the brakes and throttle. Before working on a locomotive, each worker runs or "swipes" his card through the control box, which causes at least the brakes of the locomotive to be applied, and preferably also inhibits the throttle of the locomotive.

When the repair and/or inspection is completed, each worker again inserts his card into the control box. This second "swiping" of the card clears the control of the box over the brakes and throttle. The restraint, however, is not released until all cards have been swiped, the box having a memory that recorded the first insertion of the cards and recorded the total number of such cards. When all of the workers have run their cards through the box the second time, the box clears the brakes and throttle so that the locomotive is free to be moved.

A Shift Supervisor can be provided with a master key to clear the control box if a worker loses his card or leaves without clearing the box. This prevents the locomotive from being "frozen" in place if no one is actually working on the locomotive.

OBJECTS OF THE INVENTION

It is, therefore, a primary object of the invention to ensure the safety of personnel working on locomotives by use of means under the direct control of the workers themselves that inhibits movement of the locomotive.

Another object of the invention is to have such personnel apply the brakes of a locomotive by inserting a worker identification card in a control box connected to the brakes. In this manner, when the card is inserted the brakes are applied and remain applied until such worker inserts his card a second time to clear control of the box over the brakes.

Yet another object of the invention is to inhibit the throttle of the locomotive by insertion of worker identification cards in a control box.

Still another object of the invention is to energize a flashing blue light on the locomotive to alert all in the vicinity of the locomotive that the locomotive can not be moved.

Another object of the invention is to keep track of the names of workers working on a locomotive, as well as the total number of such workers and respective identification numbers, if any, of the workers.

A further object of the invention is to keep track of all locomotives that have been inspected and/or repaired, as well as the time required for such inspection and/or repair.

Yet another object of the invention is to keep track of the identity of personnel who have inspected and/or repaired a locomotive.

THE DRAWINGS

The objects and advantages of the invention will be better understood from consideration of the following detailed description and the accompanying drawing, the sole FIGURE of which is a flow diagram showing the procedures and system of the invention.

PREFERRED EMBODIMENT

Referring now to the FIGURE, a system and procedure 10 of the invention is shown in the form of a flow diagram for immobilizing a locomotive while workers inspect, repair and/or maintain the locomotive. More particularly, the system includes a control box located in the cab of a locomotive. The box is not physically shown in the drawing but is represented therein by the functions noted in the flow diagram. The box is electrically connected to the locomotive brake system which can be an electrically operated brake system such as the EPIC system developed by Westinghouse Air Brake Company. The connection can be made, for example, by a digital input signal to the EPIC system. "EPIC" is a trademark of the Westinghouse Air Brake Company.

The box is also preferably connected to the throttle of the locomotive in a manner that immobilizes the throttle. The throttle can be inhibited and released by the box forwarding digital signals to a microprocessor connected to control the throttle.

Mechanics and others having responsibilities for repair and maintenance of locomotives are assigned identification cards readable by the box of system 10. This is shown at function 12 in the drawing. Each card can contain the name of the worker and an identification number, such as his Social Security number, which is readable by the box, and which is stored in appropriate memory provided in or electrically connected to the box. The box is programmed to read and record information on each card when the card is inserted. As indicated in the drawing, the system's first function at 12 is to ascertain whether or not a card has in fact been inserted and read. If not, the system waits for a card to be inserted and read.

If a card has been inserted in the system, the question is asked at function 14 whether or not the card and the information on the card has been logged into the memory of the control box. If the card and information on the card have not been recorded (i.e., logged), the system requests at 16 that the card and its information be logged. If the answer to question posed in function 14 is "yes", the system awaits a "clearing" step at function 18 presently to be described.

When a card is read at function 12, the system 10 automatically and immediately orders the brakes of the locomotive to be applied at full service, and can also simultaneously order inhibition of the throttle of the locomotive. With the locomotive restrained in this manner, it is safe for workers to work on the locomotive without the possibility of the locomotive being moved.

In addition, the function at 16 can also order the energization of a blue flashing light on the locomotive when a card is inserted and read in the box of system 10. This assures persons in the vicinity of the locomotive that the locomotive can not be moved.

When work is completed on the locomotive, or when a shift ends, the box of system 10 is programmed to remove brake application and throttle inhibition after all of the cards that were first passed through the control box to inhibit the locomotive are again passed through the box i.e., the box of the system is programmed to note the number and identity of the cards that are passed through the box and read the second time. It all of the cards are read, the box orders release of the brakes and throttle, and deenergizes the flashing blue light. Thus, at function 18 of system 10, each card is processed in a manner that clears the log of the card.

At function 20, the system asks if all cards have been cleared. If the answer is "no" the locomotive remains restrained, as indicated by function box 22 in the drawing. If the answer is "yes" at function 20, the system releases the locomotive to an "active" state, as indicated at box 24 in the drawing.

In addition, as discussed earlier, if a worker looses his card or forgets to clear the box after leaving the locomotive, a Shift Supervisor or other person having responsibility for the locomotive can be provided with a master key to clear the system so that the locomotive can, if needed, be moved.

In clearing the control box and system, the brakes of the locomotive can remain applied if they were initially applied by an engineer or another person. The release effected by clearing the system permits an operator to subsequently manually release the brakes if they were in fact applied before the first worker entered his card into the box.

A further option can be offered by the control box of system 10 by interfacing the box with a main or master computer located in a railyard office. In this manner, such master computer can be employed to directly monitor all locomotive control boxes to provide information on which locomotive has been inspected and/or repaired, as well as the names of the personnel making the inspection and/or repairs.

The system of the invention provides security in the form of a "key" which key are the cards of all of the workers directed to work on a locomotive. Without the "key" the locomotive can not be operated, which provides the safety needed for workers. This assures that only an engineer assigned to the locomotive can operate the locomotive, and only if he has a key that can clear the system of 10.

While a preferred embodiment of the locomotive inhibiting system of the invention has been described in detail it should be understood that modifications and adaptations of the preferred embodiment can be made by those skilled in the locomotive control art without departing from the spirit and scope of the claims appended hereto.

We claim:

1. A method of preventing movement of a locomotive while personnel are working on the locomotive, the method comprising:

placing brakes of the locomotive under the control of a card reading control box, providing personnel employed to work on the locomotive with identification cards readable by the control box, inserting the cards of such personnel in said control box before work is begun on the locomotive, setting said control box to read the cards and, in response thereto, maintaining said brakes at full service until the personnel have left the locomotive, and clearing said control box and brakes after the personnel have left the locomotive so that the locomotive can be moved.

2. The method of claim 1 in which the step of clearing the control box is effected by inserting the cards into the control box a second time, the clearing of said box allowing manual release of the brakes by an operator of the locomotive if the brakes had been initially manually set.

3. The method of claim 1 in which the step of clearing the control box is effected by inserting a master key.

4. The method of claim 1 including:

setting said box to record the number of workers working on the locomotive.

5. The method of claim 1 including:

setting said box to list the identity of the workers working on the locomotive.

6. The method of claim 1 including:

setting said box to inhibit and release the throttle of the locomotive.

7. The method of claim 1 including:

setting said box to order the energization and deenergization of a flashing light on the locomotive.

8. The method of claim 1 including:

interfacing said box with a master computer to identify locomotives that have been inspected and/or repaired.

9. The method of claim 1 including:

interfacing said box with a master computer to record the time required to complete work performed on the locomotive.

10. The method of claim 1 including:

interfacing said box with a master computer to identify workers who have performed work on the locomotive.

* * * * *